US010210788B2

(12) United States Patent
Su et al.

(10) Patent No.: US 10,210,788 B2
(45) Date of Patent: Feb. 19, 2019

(54) DISPLAYING METHOD AND DISPLAY WITH SUBPIXEL RENDERING

(71) Applicant: AU Optronics Corporation, Hsin-Chu (TW)

(72) Inventors: Shang-Yu Su, Hsin-Chu (TW); Sheng-Wen Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 831 days.

(21) Appl. No.: 14/619,546

(22) Filed: Feb. 11, 2015

(65) Prior Publication Data

US 2016/0104412 A1 Apr. 14, 2016

(30) Foreign Application Priority Data

Oct. 14, 2014 (TW) ..... 103135528 A

(51) Int. Cl.
*G09G 5/10* (2006.01)
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2340/06* (2013.01)

(58) Field of Classification Search
CPC ..... G09G 2340/06; G09G 3/2003; G09G 3/2074; G09G 3/3648; G09G 2300/0452; G09G 2320/0613; G09G 2320/066
USPC ..... 345/690, 694
See application file for complete search history.

(56) References Cited

U.S. PATENT DOCUMENTS

2005/0151752 A1* 7/2005 Phan ..... G09G 3/2003 345/589
2010/0045695 A1 2/2010 Brown Elliott et al.
2011/0134152 A1* 6/2011 Furihata ..... G09G 3/3648 345/690
2011/0148908 A1* 6/2011 Jeong ..... G09G 5/02 345/590
2013/0194494 A1 8/2013 Chun et al.

* cited by examiner

*Primary Examiner* — Amr A Awad
*Assistant Examiner* — Aaron Midkiff
(74) *Attorney, Agent, or Firm* — WPAT, PC

(57) ABSTRACT

A displaying method includes following steps: converting first image data into second image data; performing subpixel rendering on second image data to generate third image data; determining whether the first image data includes first pixel data having a gray brightness value which is not greater than a first threshold; determining whether a gray brightness value of second pixel data of the third image data corresponding to the first pixel data is greater than a second threshold; and converting the third image data into fourth image data. The second pixel data is corresponding to third pixel data in the fourth image data. The third pixel data include at least one first subpixel data having a gray brightness value smaller than the gray brightness value of the subpixel data of the third image data corresponding to the first subpixel data.

20 Claims, 8 Drawing Sheets

126

| R11 | G11 | B11 | R12 | G12 | B12 | R13 | G13 | B13 |
|---|---|---|---|---|---|---|---|---|
| 0.25 | 0.5 | 0.67 | 1 | 0.9 | 0.4 | 0.43 | 0.45 | 1 |
| R21 | G21 | B21 | R22 | G22 | B22 | R23 | G23 | B23 |
| 0.68 | 0.4 | 0.7 | 0.5 | 1 | 0.9 | 0 | 0 | 0 |
| R31 | G31 | B31 | R32 | G32 | B32 | R33 | G33 | B33 |
| 0.56 | 0.72 | 0.58 | 0.56 | 0.4 | 0.2 | 0.42 | 0.33 | 0.35 |

136

| R11 | G11 | B11 | W11 | R12 | G12 | B12 | W12 | R13 | G13 | B13 | W13 |
|---|---|---|---|---|---|---|---|---|---|---|---|
| 0.13 | 0.38 | 0.55 | 0.13 | 0.8 | 0.7 | 0.2 | 0.2 | 0.22 | 0.24 | 0.79 | 0.22 |
| R21 | G21 | B21 | W21 | R22 | G22 | B22 | W22 | R23 | G23 | B23 | W23 |
| 0.48 | 0.2 | 0.5 | 0.2 | 0.25 | 0.75 | 0.65 | 0.25 | 0 | 0 | 0 | 0 |
| R31 | G31 | B31 | W31 | R12 | G12 | B12 | W12 | R12 | G12 | B12 | W12 |
| 0.28 | 0.44 | 0.3 | 0.28 | 0.46 | 0.3 | 0.1 | 0.1 | 0.26 | 0.17 | 0.19 | 0.17 |

Rendering matrix

[0.5 0.5]

146

| R11 | G11 | B12 | W12 | R13 | G13 |
|---|---|---|---|---|---|
| 0.06 | 0.19 | 0.37 | 0.16 | 0.51 | 0.47 |
| B21 | W21 | R22 | G22 | B23 | W23 |
| 0.25 | 0.1 | 0.37 | 0.48 | 0.33 | 0.13 |
| R31 | G31 | B32 | W32 | R33 | G33 |
| 0.14 | 0.22 | 0.2 | 0.19 | 0.36 | 0.23 |

B23 → 0

156

| R11 | G11 | B12 | W12 | R13 | G13 |
|---|---|---|---|---|---|
| 0.06 | 0.19 | 0.37 | 0.33 | 0.34 | 0.36 |
| B21 | W21 | R22 | G22 | B23 | W23 |
| 0.25 | 0.1 | 0.37 | 0.37 | 0 | 0.13 |
| R31 | G31 | B32 | W32 | R33 | G33 |
| 0.14 | 0.22 | 0.2 | 0.36 | 0.19 | 0.12 |

FIG. 2A

136

| R11 | G11 | B11 | W11 | R12 | G12 | B12 | W12 | R13 | G13 | B13 | W13 |
|---|---|---|---|---|---|---|---|---|---|---|---|
| 0.13 | 0.38 | 0.55 | 0.13 | 0.8 | 0.7 | 0.2 | 0.2 | 0.22 | 0.24 | 0.79 | 0.22 |
| R21 | G21 | B21 | W21 | R22 | G22 | B22 | W22 | R23 | G23 | B23 | W23 |
| 0.48 | 0.2 | 0.5 | 0.2 | 0.25 | 0.75 | 0.65 | 0.25 | 0 | 0 | 0 | 0 |
| R31 | G31 | B31 | W31 | R12 | G12 | B12 | W12 | R12 | G12 | B12 | W12 |
| 0.28 | 0.44 | 0.3 | 0.28 | 0.46 | 0.3 | 0.1 | 0.1 | 0.26 | 0.17 | 0.19 | 0.17 |

| R11 | G11 | B11 | W11 | R12 | G12 | B12 | W12 | R13 | G13 | B13 | W13 |
|---|---|---|---|---|---|---|---|---|---|---|---|
| 0.25 | 0.5 | 0.67 | 0 | 0.6 | 0.5 | 0 | 0.4 | 0.43 | 0.45 | 1 | 0 |
| R21 | G21 | B21 | W21 | R22 | G22 | B22 | W22 | R23 | G23 | B23 | W23 |
| 0.28 | 0 | 0.3 | 0.4 | 0.5 | 1 | 0.9 | 0 | 0 | 0 | 0 | 0 |
| R31 | G31 | B31 | W31 | R12 | G12 | B12 | W12 | R12 | G12 | B12 | W12 |
| 0.56 | 0.72 | 0.58 | 0 | 0.36 | 0.2 | 0 | 0.2 | 0.42 | 0.33 | 0.35 | 0 |

136a

Rendering matrix
[0.5 0.5]

146a

| R11 | G11 | B12 | W12 | R13 | G13 |
|---|---|---|---|---|---|
| 0.13 | 0.25 | 0.34 | 0.2 | 0.52 | 0.48 |
| B21 | W21 | R22 | G22 | B23 | W23 |
| 0.15 | 0.2 | 0.39 | 0.5 | 0.45 | 0 |
| R31 | G31 | B32 | W32 | R33 | G33 |
| 0.28 | 0.36 | 0.29 | 0.1 | 0.39 | 0.27 |

B23 → 0

| R11 | G11 | B12 | W12 | R13 | G13 |
|---|---|---|---|---|---|
| 0.13 | 0.25 | 0.34 | 0.43 | 0.29 | 0.33 |
| B21 | W21 | R22 | G22 | B23 | W23 |
| 0.15 | 0.2 | 0.39 | 0.35 | 0 | 0 |
| R31 | G31 | B32 | W32 | R33 | G33 |
| 0.28 | 0.36 | 0.29 | 0.33 | 0.16 | 0.12 |

156a

FIG. 3

DISPLAYING METHOD AND DISPLAY WITH SUBPIXEL RENDERING

RELATED APPLICATIONS

This application claims priority to Taiwan Application Serial Number 103135528 filed Oct. 14, 2014, which is herein incorporated by reference.

BACKGROUND

Field of Invention

The present invention relates to a displaying method. More particularly, the present invention relates to a displaying method and a display for increasing a contrast of an image or text.

Description of Related Art

With the development of technology, resolution and brightness of a display panel nowadays is continuously increasing to respond to the need for high quality images, games frames and navigation applications. However, the increase of the resolution of the display panel generally decreases an aperture ratio of a pixel, and thus decreases brightness of frames viewed under the same backlight source. In order to tackle the problem, the current industry has developed technology to increase the area of subpixels for increasing the aperture ratio and to reconvert and redistribute image signals according to the arrangement (e.g. PenTile arrangement) of the subpixels with different colors on the display panel, such as performing subpixel rendering on the image signals. As a result, visual resolution close to the resolution of a high resolution display using RGB pixel arrangement can be achieved.

However, although the aforementioned approach may increase visual resolution of a displayed image, a conventional algorithm for the conversion (e.g. subpixel rendering) generally produces color expansion at edges of images or text, thus decreasing the contrast at the edges of the displayed images or text, affecting the clarity of the images or text.

SUMMARY

Therefore, an aspect of the invention is to provide a displaying method suitable for use in a display. The display includes first pixel units and second pixel units, and each of the first pixel units includes a white subpixel. The displaying method includes following steps: converting first image data into second image data; performing subpixel rendering on the second image data corresponding to the first pixel units and the second pixel units, thereby generating third image data; determining whether the first image data includes first pixel data having a gray brightness value which is not greater than a first threshold; if the first image data comprises the first pixel data having the gray brightness value not greater than the first threshold, determining whether a gray brightness value of second pixel data in the third image data corresponding to the first pixel data is greater than a second threshold; if the gray brightness value of the second pixel data is greater than the second threshold, converting the third image data into fourth image data, and displaying the fourth image data using the display. The second pixel data is corresponding to third pixel data in the fourth image data. The third pixel data includes at least one first subpixel data. The gray brightness value of the first subpixel data is smaller than a gray brightness value of subpixel data in the third image data corresponding to the first subpixel data. A gray brightness value of at least one second subpixel data in the fourth image data is greater than a gray brightness value of subpixel data in the third image data corresponding to the second subpixel data.

Another aspect of the invention is to provide a display includes a display panel, an image converting module, a processing module and a controlling module. The display panel includes first pixel units and second pixel units. Each of the first pixel units includes a white subpixel. The image converting module converts first image data into second image data. The processing module is electrically connected to the image converting module, and configured to perform subpixel rendering on the second image data corresponding to the first pixel units and the second pixel units, thereby generating third image data. The controlling module is electrically connected to the processing module and the display panel, and configured to determine whether the first image data comprises first pixel data having a gray brightness value which is not greater than a first threshold. If the first image data includes the first pixel data having the gray brightness value not greater than the first threshold, the controlling module determines whether a gray brightness value of second pixel data in the third image data corresponding to the first pixel data is greater than a second threshold. If the gray brightness value of the second pixel data is greater than the second threshold, the controlling module converts the third image data into fourth image data, and transmits the fourth image data to the display panel for displaying. The second pixel data is corresponding to third pixel data in the fourth image data. The third pixel data includes at least one first subpixel data. A gray brightness value of the first subpixel data is smaller than a gray brightness value of subpixel data in the third image data corresponding to the first subpixel data. A gray brightness value of at least one second subpixel data in the fourth image data is greater than a gray brightness value of subpixel data in the third image data corresponding to the second subpixel data.

The invention first obtains pixel data in the inputted image data having the gray brightness value which is not greater than a first threshold, and then determines whether the gray brightness value of the corresponding pixel data in the image data after the subpixel rendering is performed is greater than a second threshold. When the gray brightness value of the pixel data is greater than the second threshold, the gray brightness value of subpixel data of the corresponding pixel data is decreased, and the gray brightness values of other peripheral subpixel data of the target subpixel data on the display panel are correspondingly adjusted. Accordingly, the gray brightness value of the target subpixel data is decreased without affecting the summation of the gray brightness values of the peripheral subpixel data. As a result, the contrast decrease of images or text caused by performing the subpixel rendering is alleviated.

In addition, the invention performs corresponding adjustments on the gray brightness values of subpixel data of pixel data according to whether the pixel unit on the display panel corresponding to the pixel data to be subpixel rendered includes a white subpixel. As a result, the contrast of images or text displayed at the boundaries of the subpixels on the display panel corresponding to the subpixel data in the subpixel rendered image is increased. Accordingly, after the adjustment and the subpixel rendering are performed on the image data, the adjustment of the gray brightness values of subpixel data described in the previous paragraphs is further performed, and thus the contrast of images or text is further increased.

BRIEF DESCRIPTION OF THE DRAWINGS

The invention can be more fully understood by reading the following detailed description of the embodiment, with reference made to the accompanying drawings as follows:

FIG. 2A is a schematic diagram illustrating, in an example, gray brightness values of subpixel data in image data which are processed, converted and displayed in a display according to an embodiment of the present invention.

FIG. 3 is a schematic diagram illustrating, in an example, gray brightness values of subpixel data in image data which are processed, converted and displayed on a display according to another embodiment of the present invention;

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size. For the convenience of understanding, identical units in the description are described with the same labels.

A term used in the specification and the claims has general meaning, unless it is particularly noted, of the term used in this field, in the content of the description and in the special content. Some terms used for describing the disclosure will be discussed below or in other part of the specification to provide an additional guide of description related to the disclosure for people in the art.

Moreover, "couple" or "connected" used in the specification means two or more components are physically or electrically connected to the each other directly or indirectly, or it may also mean interactions or interoperations of the two or more components.

In the specification, the using of "a", "an" and "the" intends to cover singular and plural forms except that it is clearly indicated in the specification. It should be understood that, terms of "comprise" and "include" used in the specification are for indicating particular features, integers, steps, operations, units and/or components, but not limited to adding one or more other features, integers, steps, operations, units and/or components.

In addition, the using of "first", "second", "third", etc. in the specification should be understood for describing a specific unit, component, area, layer and/or block. But the unit, component, area, layer and/or block should not be limited by the terms. The terms are only for identifying a single unit, component, area, layer and/or block. Therefore, a first unit, component, area, layer and/or block may also be referred to a second unit, component, area, layer and/or block without departing from the spirit and range of the invention.

Figure 1:
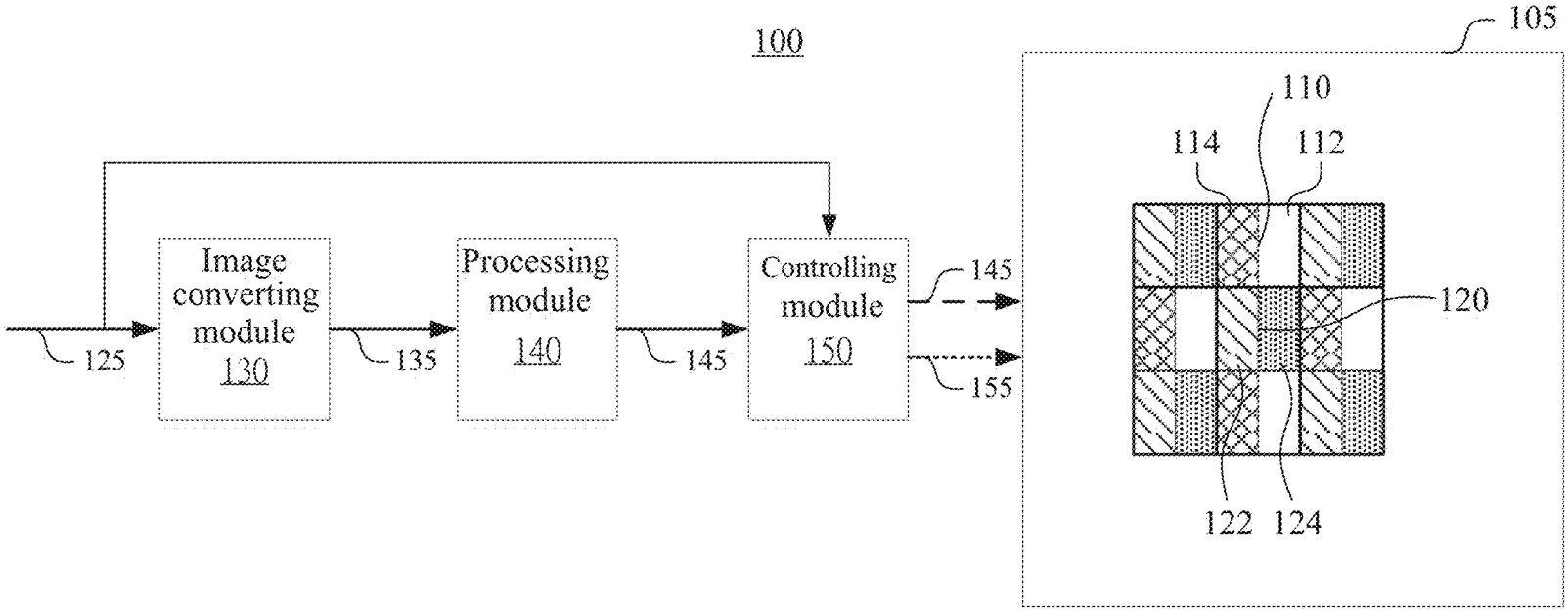
FIG. 1 is a schematic block diagram of a display in an embodiment of the present invention.

FIG. 1 is a schematic block diagram of a display 100 in an embodiment of the present invention. Referring to FIG. 1, the display 100 includes a display panel 105, an image converting module 130, a processing module 140 and a controlling module 150. The image converting module 130 converts first image data 125 into second image data 135. In an embodiment, the first image data 125 is RGB (red-green-blue) image data, and the second image data 135 is RGBW (red-green-blue-white) image data. The processing module 140 is used to convert the second image data 135 into third image data 145. The controlling module 150 is used to selectively convert the third image data 145 into fourth image data 155, and to selectively transmit the third image data 145 or the fourth image data 155 to the display panel 105 for displaying.

In an embodiment, the image converting module 130, the processing module 140 and the controlling module 150 are individual chips, or are collectively integrated in one chip. In another embodiment, the display 100 includes at least one processor and a memory, and the image converting module 130, the processing module 140 and the controlling module 150 are stored in the memory. The processor reads out the memory to execute the functions of the modules.

The display panel 105 includes more than one first pixel units 110 and more than one second pixel units 120. Each first pixel unit 110 includes a white subpixel 112. In an embodiment, each first pixel unit 110 further includes a first color subpixel 114, and each second pixel unit 120 includes a second color subpixel 122 and a third color subpixel 124. The first color subpixel 114 may be a blue subpixel, the second color subpixel 122 may be a red subpixel, and the third color subpixel 124 may be a green subpixel. It is noted that the colors corresponding to the subpixels are not limited by the embodiments, and people in the art may make the configuration according to the practical needs.

Moreover, in the display panel 105, the number of the first pixel units 110 is not limited to four as shown in FIG. 1, and the number of the second pixel units 120 is not limited to five as shown in FIG. 1. In practical applications, the number of the first pixel units 110 and the number of the second pixel units 120 in the display panel 105 are much greater than what are shown in FIG. 1. In addition, in an embodiment, the first pixel units 110 and the second pixel units 120 are alternately arranged. Each first pixel unit 110 is adjacent to four of the second pixel units 120, and each second pixel unit 120 is adjacent to four of the first pixel units 110.

Figure 2B:
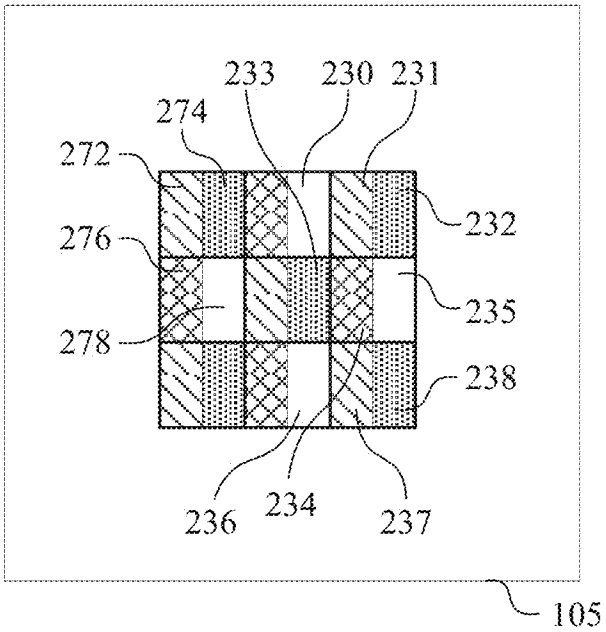
FIG. 2B is a schematic diagram illustrating a display according to an embodiment of the present invention.

Referring FIG. 2A and FIG. 2B together, FIG. 2A is a schematic diagram illustrating, in an example, gray brightness values of subpixel data in image data which are processed, converted and displayed by the display 100 according to an embodiment of the present invention, and FIG. 2B is a schematic diagram illustrating the display panel 105 according to an embodiment of the present invention. In FIG. 2B, subpixels in the display panel 105 are further labeled with reference numbers for convenience of explanation.

In a further embodiment, the first image data 125 includes gray data 126 which represents respective gray brightness values of red subpixel data, green subpixel data and blue subpixel data of nine pixel data. For example, in the gray data 126, R11, G11 and B11 represent respective gray brightness values of red subpixel data, green subpixel data and blue subpixel data of the corresponding pixel data. Nine pixel data shown in the gray data 126 are corresponding to nine pixel units shown on the display panel 105. It is obvious that the pixel data included in the first image data 125 is not limited to the nine ones shown in the gray data 126. In practical applications, the number of the pixel data included in the first image data 125 is much greater than nine.

Because each of the nine corresponding pixel units in the display panel 105 has only two subpixels and the first image data 125 is RGB image data, the display 100 needs to perform an image conversion and processes such as subpixel rendering on the first image data 125, so that the display panel 105 can show a display according to the converted image data.

As shown in FIG. 1 and FIG. 2A, the gray data 136 represents respective gray brightness values of red subpixel data, green subpixel data, blue subpixel data and white subpixel data corresponding to the nine pixel data in the second image data 135.

In detail, the image converting module 130 converts gray brightness values (e.g. gray data 126) of the red subpixel data, the green subpixel data and the blue subpixel data of each pixel data in the first image data 125 into gray brightness values (e.g. gray data 136) of the red subpixel data, the green subpixel data, the blue subpixel data and the white subpixel data of the corresponding pixel data in the second image data 135. For example, gray brightness values of R11, G11 and B11 in the gray data 126 are respectively converted into gray brightness values of R11, G11, B11 and W11 in the gray data 136. Gray brightness values of R22, G22 and B22 in the gray data 126 are respectively converted into gray brightness values of R22, G22, B22 and W22 in the gray data 136.

In an embodiment, the conversion of the gray brightness values of subpixel data between the first image data 125 and the second image data 135 is determined, but not limited to, according to the following formulas:

$$W=\min(\alpha*Ri,\alpha*Gi,\alpha*Bi)/2$$

$$R=\alpha*Ri-W$$

$$G=\alpha*Gi-W$$

$$B=\alpha*Bi-W,$$

$\alpha$ denotes a coefficient. Ri, Gi and Bi denote respective gray brightness values of red subpixel data, green subpixel data and blue subpixel data of one pixel data in the gray data 126. R, G, B and W denote respective gray brightness values of red subpixel data, green subpixel data, blue subpixel data and white subpixel data of the corresponding pixel data in the gray data 136.

In addition, referring to the gray data 126 and gray data 136, it is noted that the gray brightness values of R23, G23 and B23 in the gray data 126 are zero, and therefore the gray brightness values of the pixel data corresponding to R23, G23 and B23 are zero. In the gray data 136, the gray brightness values of R23, G23, B23 and W23 are zero, and therefore the gray brightness values of the pixel data corresponding to the R23, G23, B23 and W23 are zero. That is, when the pixel data corresponding to the R23, G23 and B23 in the first image data 125 has gray brightness values which are zero, the corresponding pixel data in the second image data 135 also has gray brightness values which are zero.

The processing module 140 performs subpixel rendering on the first pixel units 110 and second pixel units 120 shown in FIG. 1 corresponding to the second image data 135, so as to generate the third image data 145.

The gray data 146 represents gray brightness values of the red subpixel data and the green subpixel data, or gray brightness values of the subpixel data and the white subpixel data of the nine pixel data in the third image data 145 after the subpixel rendering is performed.

In detail, the processing module 140 performs the subpixel rendering on the gray brightness values (e.g. gray data 136) of the red subpixel data, the green subpixel data, the blue subpixel data and the white subpixel data of each pixel data in the second image data 135 according to colors of the subpixels of the pixel data in the corresponding pixel unit in the display panel 105. Thereby, the processing module 140 converts the pixel data into gray brightness values (e.g. gray data 146) of the red subpixel data and the green subpixel data or gray brightness values of the blue subpixel data and the white subpixel data of the corresponding pixel data in the third image data 145.

For example, the pixel data corresponding to R11, G11, B11 and W11 of the gray data 136 in the second image data 135 is corresponding to the pixel unit constituted by a red subpixel 272 and a green subpixel 274 on the display panel 105 as shown in FIG. 2B. Therefore, the gray brightness values of R11, G11, B11 and W11 in the gray data 136 are converted into gray brightness values of R11 and G11 in the gray data 146. The pixel data corresponding to R21, R21, B21 and W21 in the gray data 136 in the second image data 135 is corresponding to the pixel unit constituted by a blue subpixel 276 and a white subpixel 278 in the display panel 105 as shown in the FIG. 2B. Therefore, gray brightness values of R21, G21, B21 and W21 in the gray data 136 are converted into gray brightness values of B21 and W21 in the gray data 146.

It should be also noted that in the embodiment of FIG. 2A, the processing module 140 uses a 1×2 rendering matrix [0.5 0.5] to convert the gray brightness values (gray data 136) of the subpixel of the pixel data in the second image data 135 into gray brightness values (gray data 146) of the subpixel data of the corresponding pixel data in the third image data 145. That is, the gray brightness values of the subpixel data in the gray data 146 are determined according to gray brightness values of the subpixel data having the same color in the corresponding pixel data in the gray data 136, and gray brightness values of the subpixel data having the same color in pixel data left adjacent to the corresponding pixel data in the gray data 136.

For example, the gray brightness value of G22 in the gray data 146 is determined according to the following formula:

$$G22=0.5*0.75+0.5*0.2=0.48$$

The coefficients of 0.5 are determined according to the elements of the rendering matrix. 0.75 is the gray brightness value of G22 in the gray data 136. 0.2 is the gray brightness value of G21 in the gray data 136. G21 is located at left side of G22 in the gray data 136. The gray brightness value of B23 in the gray data 146 is determined according to the following formula:

$$B23=0.5*0+0.5*0.65=0.33$$

0 is the gray brightness value of B23 in the gray data 136. 0.65 is the gray brightness value of B22 in the gray data 136. B22 is located at left side of B23 in the gray data 136.

Certainly, the way of the processing module 140 performing the subpixel rendering on the second image data 135 corresponding to the first pixel units 110 and the second pixel units 120 is not limited to using the aforementioned 1×2 rendering matrix. People in the art can decide the way of the processing module 140 performing the subpixel rendering on the second image data 135 according to practical needs. In an embodiment, the processing module 140 uses a 3×3 rendering matrix to perform the subpixel rendering on the second image data 135.

The operation of the controlling module 150 is described in detail below with reference to the gray data 156. The gray data 156 is gray brightness values of the subpixel data of nine pixel data in the fourth image data 155 corresponding to the gray data 146.

The controlling module 150 determines whether the first image data 125 includes first pixel data having a gray brightness value which is not greater than a first threshold.

If the first image data 125 does not include the pixel data having the gray brightness value not greater than the first threshold, the controlling module 150 transmits the third image data 145 to the display panel 105 for displaying.

If the first image data 125 includes the pixel data having the gray brightness value not greater than the first threshold, the controlling module 150 determines whether a gray brightness value of second pixel data in the third image data 145 corresponding to the first image data 125 is greater than a second threshold.

The first threshold and the second threshold may be 0, 0.01, 0.02, 0.1, 0.2, etc., but are not limited thereto. People in the art can determine or adjust the first threshold and the second threshold according to practical needs. In addition, the first threshold and the second threshold may be the same or different from the each other.

In an embodiment, the first threshold is 0.1, and the controlling module 150 determines whether the first image data 125 includes the first pixel data having the gray brightness value is not greater than the according to following formula:

$$T=a\times R_1+b\times G_1+c\times B_1$$

$R_1$, $G_1$ and $B_1$ denote respective gray brightness values of R, G, and B data of the first pixel data. a, b, and c are coefficients greater than 0. When T<=0.1, the controlling module 150 determines that the first image data 125 includes the first pixel data having the gray brightness value not greater than the first threshold (0.1). In an example, a=0.299, b=0.578, and c=0.114.

In another embodiment, the first threshold is zero, and the controlling module 150 determines whether the first image data 125 includes the first pixel data having the gray brightness value not greater than the first threshold (zero) according to whether the gray brightness values of R, G, and B data of the first pixel data are simultaneously zero.

In the embodiment of FIG. 2A, both the first threshold and the second threshold are zero. Therefore, the controlling module 150 determines that the first image data 125 includes the first pixel data (i.e. the pixel data in the first image data 125 corresponding to R23, G23 and B23 in the gray data 126) having the gray brightness value not greater than the first threshold (zero) because the gray brightness values of R23, G23 and B23 in the gray data 126 are simultaneously zero.

In the example illustrated in FIG. 2A, the first image data 125 includes the first pixel data having the gray brightness values represented by R23, G23 and B23 in the gray data 126 that are not greater than the first threshold (zero). Therefore, the controlling module 150 further determines whether the gray brightness value of the second pixel data in the third image data 145 corresponding to the first pixel data is greater than the second threshold.

The first pixel data (i.e. the pixel data represented by R23, G23 and B23 in the gray data 126) is corresponding to the pixel data represented by B23 and W23 in the gray data 146 in the third image data 145. In the example illustrated in FIG. 2A, the second threshold is zero. Therefore, the controlling module 150 determines that the gray brightness value of the second pixel data (i.e. the pixel data represented by B23 and W23 in the gray data 146) in the third image data 145 corresponding to the first pixel data is greater than the second threshold (zero) because the gray brightness values of B23 and W23 in the gray data 146 are not simultaneously zero.

If the gray brightness value of the second pixel data is not greater than the second threshold, the controlling module 150 transmits the third image data 145 to the display panel 105 for displaying. If the gray brightness value of the second pixel data is greater than the second threshold, the controlling module 150 converts the third image data 145 into fourth image data 155, and transmits the fourth image data 155 to the display panel 105 for displaying.

In the example illustrated in FIG. 2A, the controlling module 150 converts the third image data 145 into fourth image data 155 because the gray brightness value of the second pixel data is greater than the second threshold.

The second pixel data (i.e. the pixel data represented by B23 and W23 in the gray data 146) is corresponding to third pixel data (i.e. the pixel data represented by B23 and W23 in the gray data 156) in the fourth image data 155. The third pixel data includes at least one first subpixel data (e.g. the subpixel data represented by B23 in the gray data 156). The gray brightness value of the first subpixel data (in the example illustrated in FIG. 2, the gray brightness value of the subpixel data represented by B23 in the gray data 156 is 0) is smaller than the gray brightness value (e.g. the gray brightness value 0.33 of the subpixel data represented by B23 in the gray data 146) of the subpixel data in the third image data 145 corresponding to the first subpixel data.

In addition, at least one second subpixel data in the fourth image data 155 has a gray brightness value (e.g. the gray brightness value 0.33 of the subpixel data represented W12 in the gray data 156) greater than the gray brightness value (e.g. the gray brightness value 0.16 of the subpixel data represented by W12 in the gray data 146) of the subpixel data in the third image data 145 corresponding to the second subpixel data.

The operation of the controlling module 150 for converting the third image data 145 into the fourth image data 155 is described in detail below. For clarity and convenience of explanation, changes of the gray brightness values of the corresponding subpixel data in the gray data 146 and the gray data 156 are directly used for explaining the operation of the controlling module 150 performed on the gray brightness value of the subpixel data in the third image data 145 or the fourth image data 155. In addition, R12, R13, G13, G22, B23, W23, W32, R33 and G33 in the gray data 146 and the gray data 156 are corresponding to respective gray brightness values of subpixel 230~238 in the display panel 105 as shown in FIG. 2B.

In the example illustrated in FIG. 2A, after determining the gray brightness values of B23 and W23 in the gray data 146 are not simultaneously zero, the controlling module 150 decreases the gray brightness value of B23 (corresponding to the subpixel 234) in the gray data 146 from 0.33 to the gray brightness value of B23 (which is 0) in the gray data 156. During the operation, the controlling module 150 correspondingly increases the gray brightness values of W12 and W32 (respectively corresponding to the subpixels 230 and 236 diagonally adjacent to the subpixel 234) respectively from 0.16 and 0.19 to gray brightness value of W12 (which is 0.33) and gray brightness value of W32 (which is 0.36) in the gray data 156.

In addition, the controlling module 150 also correspondingly decreases R13 (corresponding to the subpixel 231 adjacent to the subpixel 234), G13 (corresponding to the subpixel 232 diagonally adjacent to the subpixel 234), G22 (corresponding to the subpixel 233 adjacent to the subpixel 234), R33 (corresponding to the subpixel 237 adjacent to the subpixel 234) and G33 (corresponding to the subpixel 238 diagonally adjacent to the subpixel 234) respectively from 0.51, 0.47, 0.48, 0.36 and 0.23 to gray brightness values of R13, G13, G22, R33 and G33 in the gray data 156 (which are 0.34, 0.36, 0.37, 0.19 and 0.12 respectively).

The operation is determined according to following principles. In the area constituted by the subpixels (i.e. subpixels 230~234 and 236~238) corresponding to W12, R13, G13, G22, B23, W32, R33 and G33 in the display panel 105, after the gray brightness value of B23 (blue) is decreased by 0.33, the gray brightness values of W12 and W32 (white) are respectively increased by 0.33/2=0.17 to compensate brightness decrease of the blue subpixel 234 caused by the decrease of the gray brightness value of B23 in the area. Therefore, the gray brightness values of W12 and W32 are respectively increased from 0.16 and 0.19 to 0.33 and 0.36. However, in the aforementioned area, after the increase of the gray brightness values of W12 and W32 (white) offsets the brightness decrease of the blue subpixel, the brightness of green and red subpixels are further visually increased.

Therefore, in order to compensate the increase of the brightness of the green and red subpixels in the aforementioned area, in an embodiment, the gray brightness value of at least one third subpixel data (preferably, the green or red subpixel corresponding to the third subpixel data in the aforementioned area) in the fourth image data 155 is correspondingly decreased, so that the gray brightness value of the third subpixel data is smaller than the gray brightness value of the subpixel data corresponding the third subpixel data in the third image data 145.

In the aforementioned example, the third subpixel data may be G13, G22, G33, R13 and R33. To be specific, the gray brightness values of G13, G22 and G33 (green) are decreased by 0.33/3=0.11. That is, the gray brightness values of G13, G22 and G33 are respectively decreased from 0.47, 0.48 and 0.23 to 0.36, 0.37 and 0.12. The gray brightness values of R13 and R33 (red) are decreased by 0.33/2=0.17. That is, the gray brightness values of R13 and R33 are respectively decreased from 0.51 and 0.36 to 0.34 and 0.19.

In the aforementioned example, the gray brightness value of target blue subpixel data is decreased without affecting the summation of the gray brightness values in the aforementioned area by increasing the gray brightness value of the white subpixel data surrounding the target blue subpixel data on the display panel and by decreasing the gray brightness values of the surrounding green and red subpixel data. As a result, the decrease of contrast of images or text caused by the performance of the subpixel rendering is alleviated.

It can be known by referring to the gray data 126, 136 and 146 that the gray brightness values of the pixel data corresponding to R23, G23 and B23 in the gray data 126 are zero, but the gray brightness values corresponding to B23 and W23 in the gray data 146 are not zero after the subpixel rendering is performed. Consequently, the contrasts of images or text displayed at the boundaries between W23 and G13, between W23 and G33, between B23 and R13, between B23 and R33, and between B23 and G22 (i.e. the boundary between the subpixel 235 and the subpixel 232, the boundary between the subpixel 235 and the subpixel 238, the boundary between the subpixel 234 and the subpixel 231, the boundary between the subpixel 234 and the subpixel 237, and the boundary between the subpixel 234 and the subpixel 233) in the gray data 146 on the display panel 105 are decreased.

In the aforementioned example, the contrasts of images or text displayed at the boundaries between B23 and R13, between B23 and R33, and between B23 and G22 (i.e. the boundary between the subpixel 234 and the subpixel 231, the boundary between the subpixel 234 and the subpixel 237, and the boundary between the subpixel 234 and the subpixel 233) in the gray data 156 on the display panel 105 is increased because the gray brightness value of B23 is decreased from 0.33 to 0.

Note that blue subpixel data is taken as an example in the above embodiment. However, in the invention, the gray brightness values of white subpixel data surrounding target green subpixel data on the display panel may be increased, and the gray brightness values of surrounding blue and red subpixel data may be decreased, so that the gray brightness value of the target green subpixel data can be decreased without affecting the summation of the gray brightness values of the subpixel data in the area. Alternatively, the gray brightness values of white subpixel data surrounding target red subpixel may be increased, and the gray brightness values of surrounding blue and green subpixel data are decreased, so that the gray brightness value of the target red subpixel can be decreased without affecting the summation of the gray brightness values of the subpixel data in the area.

Similarly, in the invention, the gray brightness values of red, green and blue subpixel data surrounding target white subpixel may be increased so that the gray brightness value of the target white subpixel data can be decreased without affecting the summation of the gray brightness values of the subpixel data in the area.

To be specific, in the example illustrated in FIG. 2A, the controlling module 150 may decrease the gray brightness value of W23 in the gray data 146, and perform corresponding adjustments on the gray brightness values of the subpixels surrounding the subpixel 235 corresponding to W23 on the display panel 105. In addition, the controlling module 150 may also simultaneously decrease the gray brightness values of B23 and W23 in the gray data 146, and perform corresponding adjustments on the gray brightness value of the subpixels surrounding the subpixel 234 and 235 corresponding to B23 and W23 on the display panel 105.

Moreover, in the example illustrated in FIG. 2A, locations of subpixels (subpixels 230 and 236) on the display panel 105 corresponding to the second subpixel data (e.g. W12 and W32) whose gray brightness value is correspondingly increased are diagonally adjacent to a location of the subpixel (subpixel 234) on the display panel 105 corresponding to the first subpixel data (e.g. B23). However, in the invention, the location of the subpixel on the display panel 105 corresponding to the second subpixel data is not limited to diagonally adjacent locations of the subpixel corresponding to the first subpixel. For example, if the gray brightness value of target green subpixel data G22 is to be decreased, the gray brightness values of the second subpixel data W12 and W32 corresponding to the subpixels 230 and 236 adjacent to the green subpixel 233 on the display panel 105 may be increased, and the corresponding operations are performed.

Furthermore, the number of the second subpixel data whose gray brightness values are correspondingly increased is not limited to two (e.g. W12 and W32) in the example above. In an embodiment, after the gray brightness value of B23 (blue) is decreased, only the gray brightness value of W12 is increased by 0.33 to compensate the decrease of brightness of the blue subpixel 234 caused by decreasing the gray brightness value of B23. That is, in the embodiment, the gray brightness value of W12 is increased from 0.16 to 0.49, and the gray brightness value of W32 is kept at 0.19.

Similarly, the number of the third subpixel data whose gray brightness values are correspondingly decreased is not limited to five (e.g. G13, G22, G33, R13 and R33) in the example above. In an embodiment, only the gray brightness values of G22 and R33 are decreased to compensate the visually increase of the gray brightness values of green and red subpixels in the adjacent area caused by increasing the gray brightness value of the white subpixel.

It should be also noted that in the invention, the gray brightness value of the first subpixel data (e.g. B23 in the gray data 156) in the fourth image data 155 is not limited to zero. The gray brightness value of the first subpixel data needs to be only lower than the gray brightness value of the subpixel data (e.g. B23 in the gray data 146) in the third image data 145 corresponding to the first subpixel data. For example, the gray brightness value of B23 in the gray data 156 may be 0.01, 0.05, 0.1 or another value, which needs to be only lower than the gray brightness value 0.33 of B23 in the gray data 146. People in the art can configure the value according to practical needs.

Please refer to FIG. 3 together. FIG. 3 is a schematic diagram illustrating, in an example, gray brightness values of subpixel data in image data which are processed, converted and displayed by a display 100 according to another embodiment of the present invention.

Compared to the embodiment illustrated in FIG. 2A, in the example illustrated in FIG. 3, the processing module 140 further decreases a gray brightness value of W subpixel data of at least one of the pixel data in the second image data 135 corresponding to the second pixel units 120, and correspondingly increases the gray brightness values of R subpixel data, G subpixel data and B subpixel data of the at least one pixel data. Furthermore, the processing module 140 increases the gray brightness value of W subpixel data of at least one of the pixel data corresponding to the first pixel unit 110 in the second image data 135, and correspondingly decreases the gray brightness values of R subpixel data, G subpixel data and B subpixel data of the at least one pixel data.

To be specific, before performing the subpixel rendering, the processing module 140 performs adjustments on the gray brightness value of the subpixel data of the pixel data according to whether the pixel unit on the display panel 105 corresponding to the pixel data in the second image data 135 includes a white subpixel.

In the embodiment, if pixel data is corresponding to one of the second pixel units 120 (not including a white subpixel) on the display panel 105, the processing module 140 decreases the gray brightness value of the W subpixel data of the pixel data, and correspondingly increases the gray brightness values of R subpixel data, G subpixel data and B subpixel data of the pixel data.

On the other hand, if pixel data is corresponding to one of the first pixel units 110 (including a white subpixel) on the display panel 105, the processing module 140 increases a gray brightness value of W subpixel data of at least one of the pixel data, and correspondingly decreases the gray brightness values of R subpixel data, G subpixel data and B subpixel data of the pixel data.

In the example illustrated in FIG. 3, the gray data 136 represents gray brightness values of red subpixel data, green subpixel data, blue subpixel data and white subpixel data corresponding to nine pixel data before the said operation is performed on the second image data 135. The gray data 136*a* represents gray brightness values of red subpixel data, green subpixel data, blue subpixel data and white subpixel data corresponding to the nine pixel data after the said operation is performed on the second image data 135.

For clarity and convenience of explanation, the operation performed by the processing module 140 on the gray brightness value of the subpixel data in the second image data 135 is described directly using changes of gray brightness values of the corresponding subpixel data in the gray data 136 and gray data 136*a*.

In the gray data 136, R11, G11, B11 and W11 on the display panel 105 are corresponding to a pixel unit (which does not include a white subpixel) constituted by the red subpixel 272 and the green subpixel 274. Therefore, the processing module 140 decreases the gray brightness value of W11 in the gray data 136 from 0.13 to the gray brightness value of W11 (which is 0) in the gray data 136*a*. Moreover, the processing module 140 also correspondingly increases the gray brightness values of R11, G11 and B11 in the gray data 136 respectively from 0.13, 0.38 and 0.55 to gray brightness values of R11, G11 and B11 (which are 0.25, 0.5 and 0.67 respectively) in the gray data 136*a* to compensate the decrease of brightness caused by decreasing the gray brightness value of W11.

In the gray data 136, R21, G21, B21 and W21 are corresponding to a pixel unit (which includes a white subpixel) constituted by the blue subpixel 276 and the white subpixel 278 on the display panel 105. Therefore, the processing module 140 increases the gray brightness value of W21 in the gray data 136 from 0.2 to the gray brightness value of W21 (which is 0.4) in the gray data 136*a*. In addition, the processing module 140 also correspondingly decreases the gray brightness values of R21, G21 and B21 in the gray data 136 respectively from 0.48, 0.2 and 0.5 to the gray brightness values of R21, G21 and B21 (which are 0.28, 0 and 0.3 respectively) in the gray data 136*a* to compensate the increase of brightness caused by increasing the gray brightness value of W11. In the embodiment illustrated in FIG. 3, the adjusting operation performed by the processing module 140 on the gray brightness values of other subpixel data in the second image data 135 is similar with the operation discussed above, and thus it will not be repeated.

In an embodiment, the processing module 140 adjusts the gray brightness values of subpixel data in the second image data 135 according to, but not limited to, following formulas:

I. If Ri, Gi, Bi and Wi are corresponding to a pixel unit not including a white subpixel, then $R=Ri+m*Wi$ $G=Gi+m*Wi$ $B=Bi+m*Wi$ $W=0;$ II. If Ri, Gi, Bi and Wi are corresponding to a pixel unit including a white subpixel on the display panel, then $R=Ri-\min(Ri,Gi,Bi)$ $G=Gi-\min(Ri,Gi,Bi)$ $B=Bi-\min(Ri,Gi,Bi)$ $W=Wi+\min(Ri,Gi,Bi)/m,$ m denotes a coefficient. Ri, Gi, Bi and Wi denote respective gray brightness values of red subpixel data, green subpixel data, blue subpixel data and white subpixel data of pixel data in the gray data 136. R, G, B and W denote respective gray brightness values of red subpixel data, green subpixel data, blue subpixel data and white subpixel data of the corresponding pixel data in the gray data 136*a*.

In addition, in the embodiment, after the processing module 140 performs the adjusting operation on the gray brightness value of subpixel data in the second image data 135, the processing module 140 performs the subpixel rendering on the adjusted second image data 135 (the gray brightness value of the subpixel data thereof is corresponding to the gray data 136*a*) to generate the third image data 145 whose gray brightness value of subpixel data is corresponding to the gray data 146*a*. Then, the controlling module 150 performs the operation discuss in the previous paragraph on the third image data 145 (the gray brightness values of the subpixel data thereof are corresponding to the gray data 146*a*) to generate the fourth image data 155 in which the gray brightness value of subpixel data is corresponding to the gray data 156*a*.

In the embodiment illustrated in FIG. 3, the processing module 140 adjusts the gray brightness value of the subpixel data of the pixel data according to whether the pixel unit on the display panel 105 corresponding to the pixel data in the second image data 135 includes a white subpixel before the subpixel rendering is performed so that after the subpixel rendering is performed, the contrast of images or text at the boundaries between the subpixels on the display panel 105 corresponding to the subpixel data in the third image data 145 is increased. Therefore, in the fourth image data 155 generated after the operation described in the previous paragraph is performed by the controlling module 150 on the third image data 145, the contrast of images or text displayed at the boundaries between the subpixels on the display panel 105 corresponding to the subpixel data is further increased.

It can be known by comparing the gray data 146*a* in FIG. 3 and the gray data 146 in FIG. 2A that the gray brightness value of W23 is 0 in the gray data 146*a*, and the gray brightness value of W23 is 0.13 in the gray data 146. Therefore, compared to the gray data 146, the contrast of images or text displayed at the boundaries between the subpixels (subpixels 235 and 232, and subpixels 235 and 238) on the display panel 105 represented by W23 and G13, and by W23 and G33 in the gray data 146*a* is increased.

Referring to FIG. 4A to FIG. 4D together, FIG. 4A to FIG. 4D are diagrams illustrating the result of displaying RGB image data on a display panel according to a simulated experiment result. The RGB image data includes a black character with a complex image as a background.

Figure 4A:
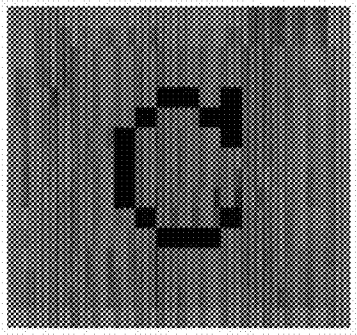
FIG. 4A is a diagram illustrating a result of displaying the image data on a display panel according to a simulated experiment result.

FIG. 4A is a result of displaying the RGB image data on a conventional RGB display panel (e.g. the result of displaying the image data corresponding to the gray data 126 as shown in FIG. 2A on a conventional RGB display panel).

Figure 4B:
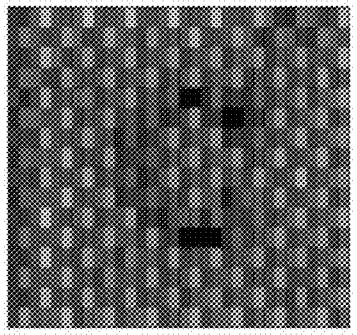
FIG. 4B is a diagram illustrating a result of displaying the image data on a display panel according to a simulated experiment result.

FIG. 4B is a result of displaying the RGB image data on a display panel whose subpixel arrangement is similar to the display panel 105 after a conventional subpixel rendering is performed (e.g. the result of displaying the image data corresponding to the gray data 146 as shown in FIG. 2A on the display panel 105). Observing FIG. 4B and comparing to FIG. 4A, the character in the FIG. 4B is blurred because the rendering of the background image.

Figure 4C:
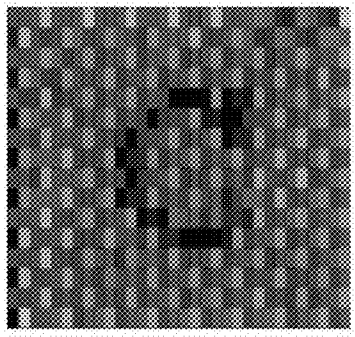
FIG. 4C is a diagram illustrating a result of displaying the image data on a display panel according to a simulated experiment result.

FIG. 4C is a result of displaying the RGB image data on a display panel whose subpixel arrangement is similar to the display panel 105, in which the adjusting operation of the gray brightness values of subpixel between the gray data 136 and gray data 136*a* illustrated in the embodiment of FIG. 3 is first performed before the conversion of the subpixel rendering is performed, and then the conversion of the subpixel rendering is performed (e.g. the result of displaying the image data corresponding to the gray data 146*a* as shown in FIG. 3 on the display panel 105). Observing FIG. 4C and comparing to FIG. 4B, the contrast of the character is significantly increased after the adjustment of the gray brightness values of the subpixels is performed on the image data.

Figure 4D:
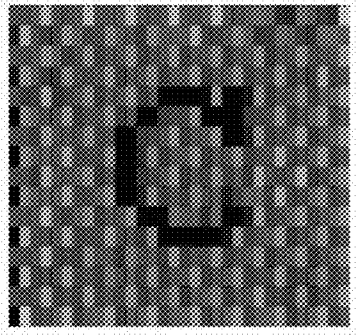
FIG. 4D is a diagram illustrating a result of displaying the image data on a display panel according to a simulated experiment result.

FIG. 4D is a result of displaying the RGB image data on a display panel whose subpixel arrangement is similar to the display panel 105, in which after the adjustment shown in FIG. 4C and the subpixel rendering conversion are first performed, and then the operation executed by the controlling module 150 is performed on the image data (e.g. the result of displaying the image data corresponding to the gray data 156*a* as shown in FIG. 3 on the display panel 105). Observing FIG. 4D and comparing to FIG. 4C, note that the contrast of the character is further increased after the operation executed by the controlling module 150 is performed on the image data. The clarity of the edges of the character in FIG. 4D is quite close to the clarity of the edges of the character in FIG. 4A.

Figure 5:
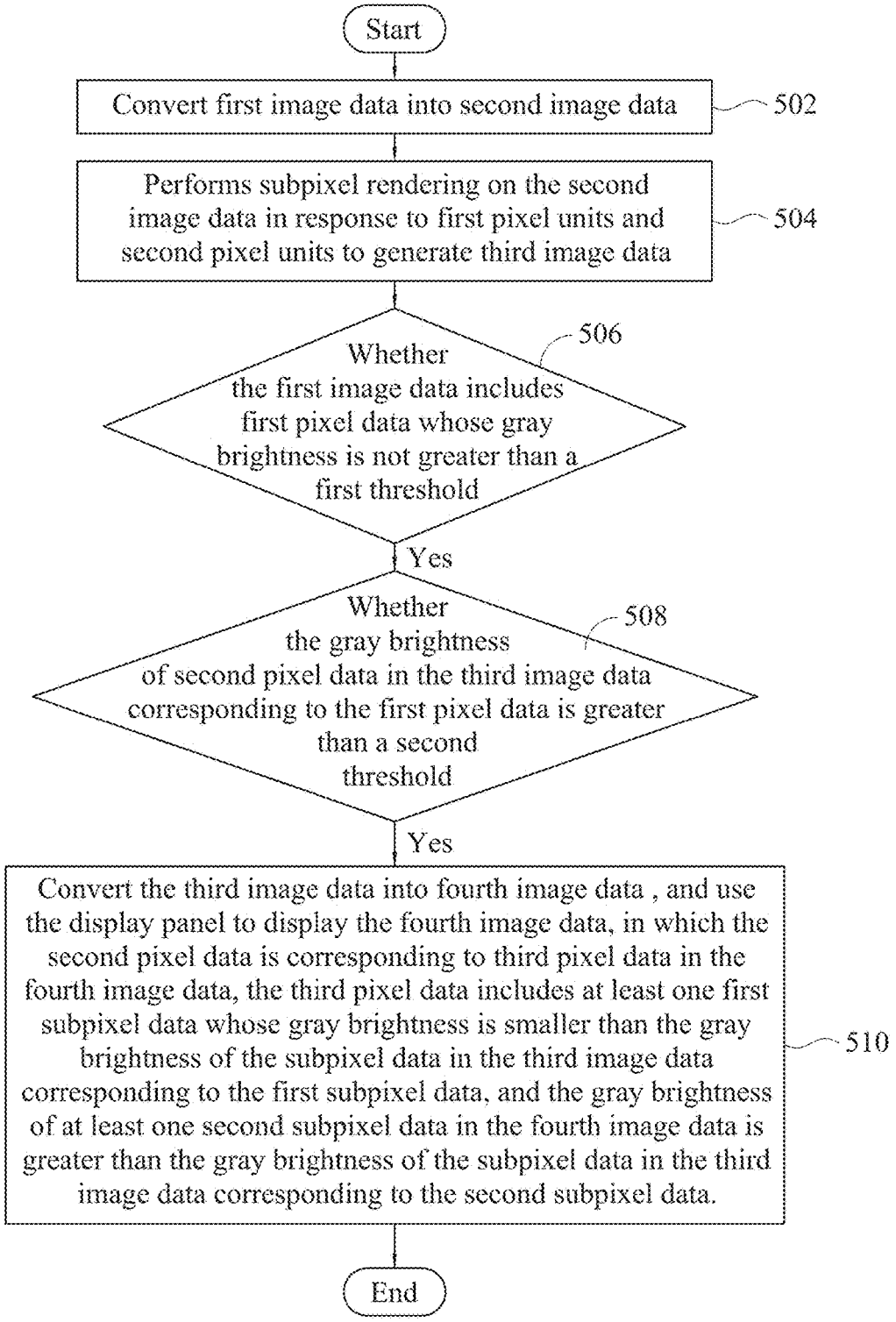
FIG. 5 is schematic flow chart illustrating a displaying method according to an embodiment of the present invention.

FIG. 5 is schematic flow chart illustrating a displaying method according to an embodiment of the present invention. The displaying method can be applied to, but not limited to, the display 100 shown in FIG. 1. For clarity and convenience of explanation, the displaying method is described with reference to the display 100 shown in FIG. 1.

In a step 502, the image converting module 130 converts the first image data 125 into the second image data 135.

In a step 504, the processing module 140 performs the subpixel rendering on the second image data 135 corresponding to the first pixel units 110 and the second pixel units 120 to generate the third image data 145.

In a step 506, the controlling module 150 determines whether the first image data 125 includes first pixel data having a gray brightness value which is not greater than a first threshold. If the first image data 125 includes the first pixel data having the gray brightness value not greater than the first threshold, in step 508, the controlling module 150 determines whether the gray brightness value of the second pixel data in the third image data 145 corresponding to the first pixel data is greater than a second threshold. In an embodiment, if the first image data 125 does not include the pixel data having the gray brightness value not greater than the first threshold, or the gray brightness value of the second pixel data is not greater than the second threshold, then the controlling module transmits the third image data 145 to the display panel 105 of the display 100 for using the display panel 105 of the display 100 to display the third image data 145.

If the gray brightness value of the second pixel data is greater than the second threshold, then in a step 510, the controlling module 150 converts the third image data 145 into the fourth image data 155, and transmits the fourth image data 155 to the display panel 105 of display 100 to use the display panel 105 of the display 100 to display the fourth image data 155. The second pixel data is corresponding to third pixel data in the fourth image data 155. The third pixel data includes at least one first subpixel data having the gray brightness value smaller than the gray brightness value of the subpixel data in the third image data 145 corresponding to the first subpixel data, and the gray brightness value of at least one second subpixel data in the fourth image data 155 is greater than the gray brightness value of the subpixel data in the third image data 145 corresponding to the second subpixel data.

Figure 6:
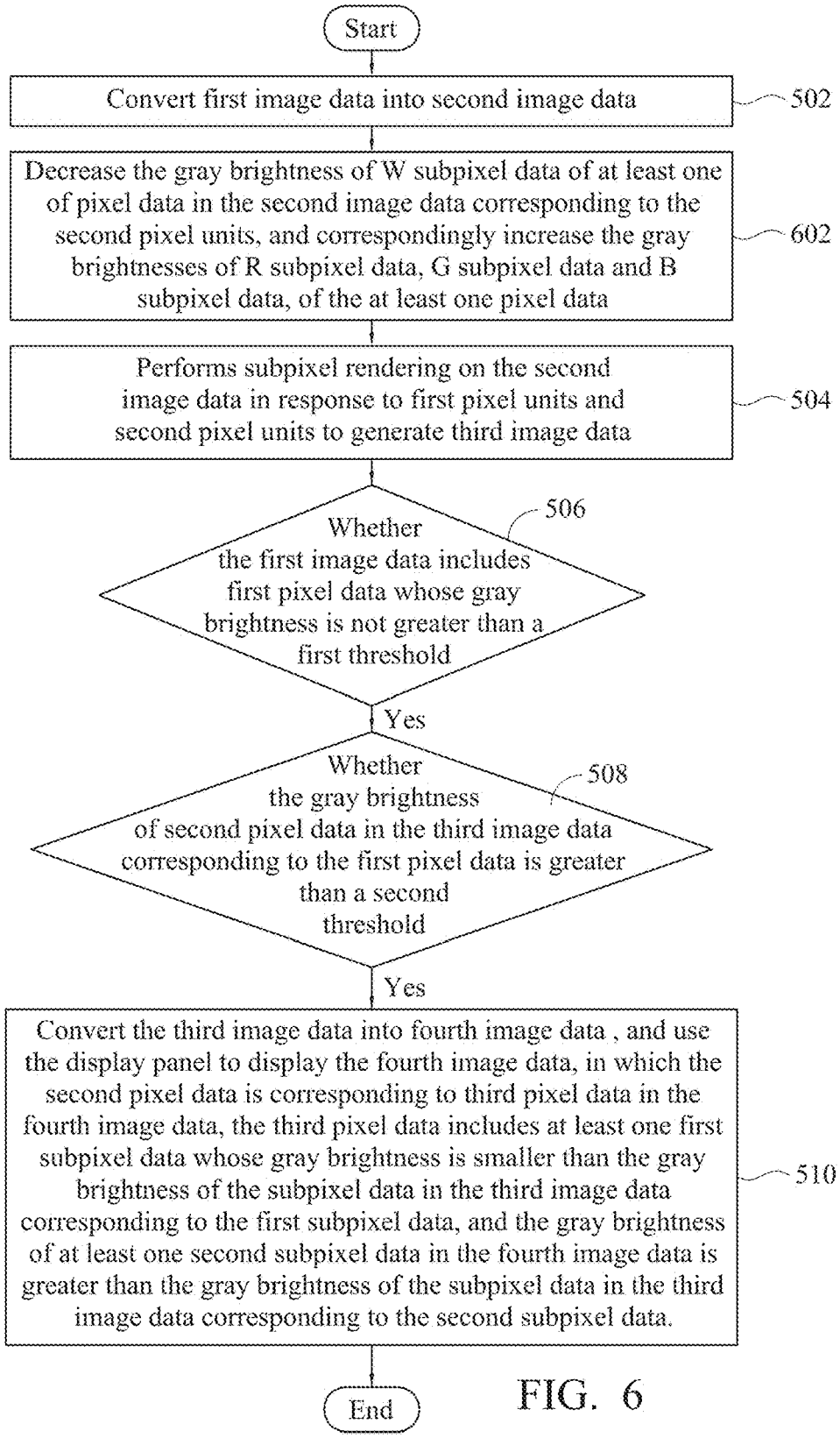
FIG. 6 is schematic flow chart illustrating a displaying method according to an embodiment of the present invention.

Referring to FIG. 6, FIG. 6 is schematic flow chart illustrating a displaying method according to an embodiment of the present invention. Compared to the displaying method shown in FIG. 5, in the embodiment, the displaying method further includes a step 602. The displaying method can be applied to, but not limited to, the display 100 shown in FIG. 1. For clarity and convenience of explanation, the displaying method is described with reference to the display 100 shown in FIG. 1.

In the step 602, the processing module 140 decreases the gray brightness value of W subpixel data of at least one of pixel data in the second image data 135 corresponding to the second pixel units 120, and correspondingly increases the gray brightness values of R subpixel data, G subpixel data and B subpixel data, of the at least one pixel data.

Figure 7:
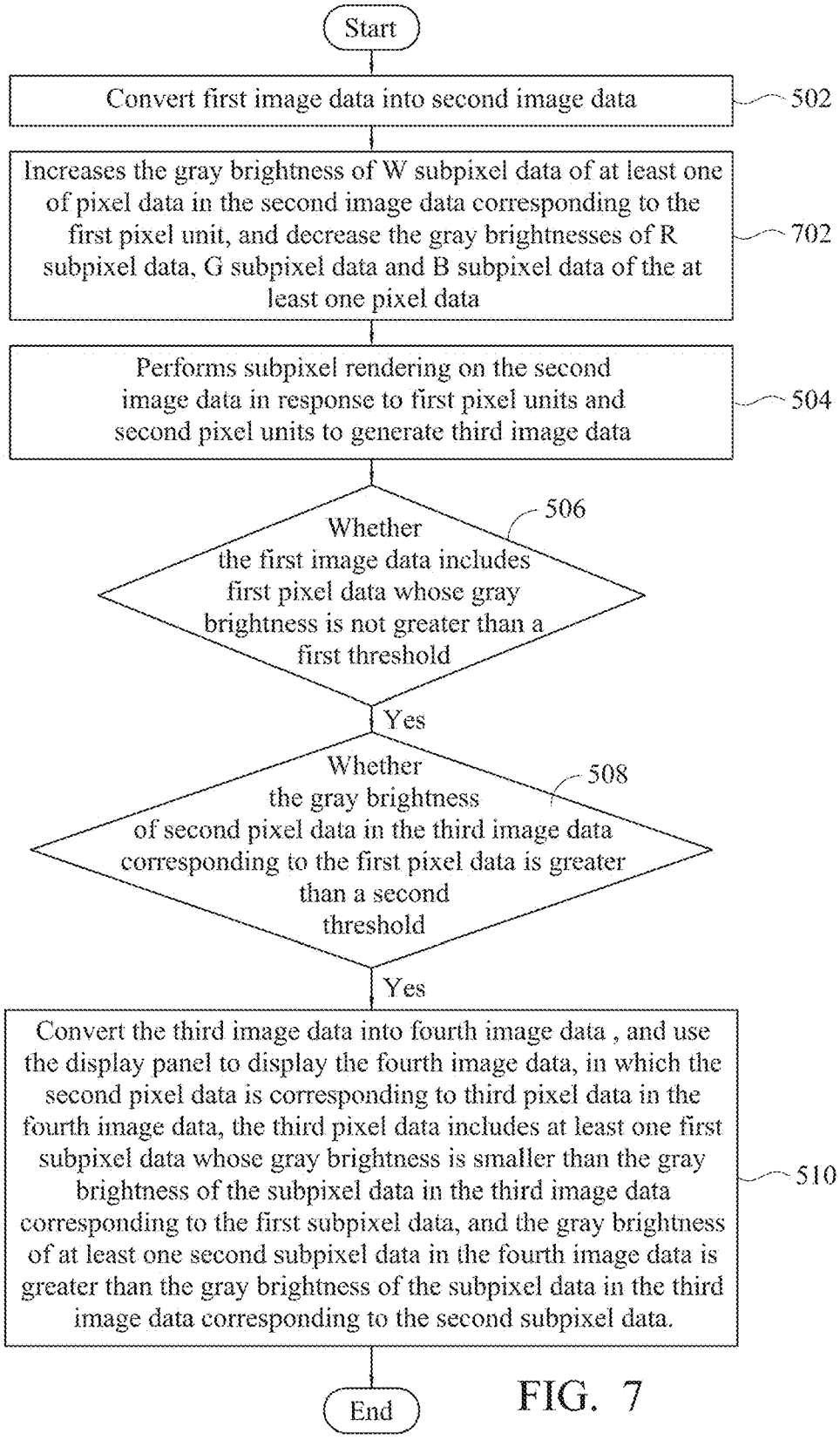
FIG. 7 is schematic flow chart illustrating a displaying method according to an embodiment of the present invention.

Referring to FIG. 7, FIG. 7 is schematic flow chart illustrating a displaying method according to an embodiment of the present invention. Compared to the displaying method shown in FIG. 5, in the embodiment, the displaying method further includes a step 702. The displaying method can be applied to, but not limited to, the display 100 shown in the FIG. 1. For clarity and convenience of explanation, the displaying method is described with reference to the display 100 shown in FIG. 1.

In the step 702, the processing module 140 increases the gray brightness value of W subpixel data of at least one of pixel data in the second image data 135 corresponding to the first pixel unit 110, and decreases the gray brightness values of R subpixel data, G subpixel data and B subpixel data of the at least one pixel data.

It should be understood that the order of the steps mentioned in the embodiments can be adjusted unless the order is specifically described, and it can even be performed simultaneously or partially simultaneously.

In summary, the invention first obtains pixel data in the inputted image data having the gray brightness value which is not greater than a first threshold, and then determines whether the gray brightness value of the corresponding pixel data in the image data after the subpixel rendering is performed is greater than a second threshold. When the gray brightness value of the pixel data is greater than the second threshold, the gray brightness value of subpixel data of the corresponding pixel data is decreased, and the gray brightness values of other peripheral subpixel data of the target subpixel data on the display panel are correspondingly adjusted. Accordingly, the gray brightness value of the target subpixel data is decreased without affecting the summation of the gray brightness values of the peripheral subpixel data. As a result, the decrease of the contrast of images or text caused by performing the subpixel rendering is alleviated.

In addition, the invention performs corresponding adjustments on the gray brightness values of subpixel data of pixel data according to whether the pixel unit on the display panel corresponding to the pixel data on which the subpixel rendering is to be performed includes a white subpixel. As a result, the contrast of images or text displayed at the boundaries of the subpixels on the display panel corresponding to the subpixel data in the image on which the subpixel rendering is already performed is increased. Accordingly, after the adjustment and the subpixel rendering are performed on the image data, the adjustment of the gray brightness values of subpixel data described in the previous paragraph is further performed, and thus the contrast of images or text is further increased.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A displaying method for a display comprising a plurality of first pixel units and a plurality of second pixel units, wherein each of the first pixel units comprises a white subpixel, the displaying method comprising:

converting first image data into second image data;

performing subpixel rendering on the second image data corresponding to the first pixel units and the second pixel units, thereby generating third image data;

determining whether the first image data comprises first pixel data having a gray brightness value which is not greater than a first threshold;

when the first image data comprises the first pixel data having the gray brightness value which is not greater than the first threshold, determining whether a gray brightness value of second pixel data in the third image data corresponding to the first pixel data is greater than a second threshold; and when the gray brightness value of the second pixel data is greater than the second threshold, converting the third image data into fourth image data, and displaying the fourth image data using the display, wherein the second pixel data corresponding to third pixel data in the fourth image data, and the third pixel data comprises at is least one first subpixel data, and a gray brightness value of the at least one first subpixel data is smaller than a gray brightness value of subpixel data in the third image data corresponding to the at least one first subpixel data, and a gray brightness value of at least one second subpixel data in the fourth image data is greater than a gray brightness value of subpixel data in the third image data corresponding to the at least one second subpixel data, wherein a subpixel location on a display panel of the display corresponding to the second subpixel data is directly adjacent to a subpixel location on the display panel of the display corresponding to the first subpixel data, or is directly diagonally adjacent to the subpixel location on the display panel of the display corresponding to the first subpixel data.

2. The displaying method of claim 1, wherein the first pixel units and the second pixel units are arranged alternatively, and each of the first pixel units is adjacent to four of the second pixel units, and each of the second pixel units is adjacent to four of the first pixel units.

3. The displaying method of claim 1, wherein the second subpixel data only comprises one or more white subpixels.

4. The displaying method of claim 1, wherein the gray brightness value of the first subpixel data is zero.

5. The displaying method of claim 1, wherein a gray brightness value of at least one third subpixel data in the fourth image data is smaller than a gray brightness value of subpixel data in the third image data corresponding to the at least one third subpixel data.

6. The displaying method of claim 5, wherein a subpixel location on a display panel of the display corresponding to the third subpixel data is adjacent to a subpixel location on the display panel of the display corresponding to the first subpixel data or is diagonally adjacent to the subpixel location on the display panel of the display corresponding to the first subpixel data, wherein the third subpixel data does not comprise any white subpixel.

7. The displaying method of claim 1, wherein the first threshold is zero, and the operation of determining whether the first image data comprises the first pixel data having the gray brightness value which is not greater than the first threshold is performed according to whether respective gray brightness values of R, G, and B data of the first pixel data are simultaneously zero.

8. The displaying method of claim 1, wherein the first threshold is 0.1, and the operation of determining whether the first image data comprises the first pixel data having the gray brightness value which is not greater than the first threshold is performed according to the following formula:

$$T=a\times R_1+b\times G_1+b\times B_1;$$

wherein $R_1$, $G_1$ and $B_1$ denote respective gray brightness values of R, G, and B data of the first pixel data; a, b, and c denote coefficients greater than 0; and when $T<=0.1$, it is determined that the first image data comprises the first pixel data having the gray brightness value which is not greater than the first threshold.

9. The displaying method of claim 1, further comprising:

decreasing a gray brightness value of W subpixel data of at least one of pixel data in the second image data corresponding to the second pixel units, and correspondingly increasing respective gray brightness values of R subpixel data, G subpixel data and B subpixel data of the at least one of the pixel data.

10. The displaying method of claim 1, further comprising:

increasing a gray brightness value of W subpixel data of at least one of pixel data in the second image data corresponding to the first pixel units, and correspondingly decreasing respective gray brightness values of R subpixel data, G subpixel data and B subpixel data of the at least one of the pixel data.

11. A display comprising: a display panel comprising:

a plurality of first pixel units, wherein each of the first pixel units comprises a white subpixel; and a plurality of second pixel units;

an image converting module configured to convert first image data into second image data;

a processing module electrically connected to the image converting module, and configured to perform subpixel rendering on the second image data corresponding to the first pixel units and the second pixel units, thereby generating third image data; and a controlling module electrically connected to the processing module and the display panel, and configured to determine whether the first image data comprises first pixel data having a gray brightness value which is not greater than a first threshold, if the first image data comprises the first pixel data having the gray brightness value which is not greater than the first threshold, the controlling module determines whether a gray brightness value of second pixel data in the third image data corresponding to the first pixel data is greater than a second threshold, if the gray brightness value of the second pixel data is greater than the second threshold, the controlling module converts the third image data into fourth image data, and transmits the fourth image data to the display panel for displaying, wherein the second pixel data is corresponding to third pixel data in the fourth image data, and the third pixel data comprises at least one first subpixel data, and a gray brightness value of the at least one first subpixel data is smaller than a gray brightness value of subpixel data in the third image data corresponding to the at least one first subpixel data, and a gray brightness value of at least one second subpixel data in the fourth image data is greater than a gray brightness value of subpixel data in the third image data corresponding to the at least one second subpixel data, wherein a subpixel location on the display panel of the display corresponding to the second subpixel data is directly adjacent to a subpixel location on the display panel of the display corresponding to the first subpixel data, or is directly diagonally adjacent to the subpixel location on the display panel of the display corresponding to the first subpixel data.

12. The display of claim 11, wherein the first pixel units and the second pixel units are arranged alternatively, and each of the first pixel units is adjacent to four of the second pixel units, and each of the second pixel units is adjacent to four of the first pixel units.

13. The display of claim 11, wherein the second subpixel data only comprises one or more white subpixels.

14. The display of claim 11, wherein a gray brightness value of the first subpixel data is zero.

15. The display of claim 11, wherein a gray brightness value of at least one third subpixel data in the fourth image data is smaller than a gray brightness value of subpixel data in the third image data corresponding to the at least one third subpixel data.

16. The display of claim 15, wherein a subpixel location on the display panel of the display corresponding to the third subpixel data is adjacent to a subpixel location on the display panel of the display corresponding to the first subpixel data or is diagonally adjacent to the subpixel location on the display panel of the display corresponding to the first subpixel data, wherein the third subpixel data does not comprise any white subpixel.

17. The display of claim 11, wherein the first threshold is zero, and the controlling module determines whether the first image data comprises the first pixel data having the gray brightness value which is not greater than the first threshold according to whether respective gray brightness values of R, G, and B data of the first pixel data are simultaneously zero.

18. The display of claim 11, wherein the first threshold is 0.1, and the controlling module determines whether the first image data comprises the first pixel data having the gray brightness value which is not greater than the first threshold according to the following formula:

$$T=a\times R_1+b\times G_1+b\times B_1;$$

wherein R1, G1 and B1 denote respective gray brightness values of R, G, and B data of the first pixel data; a, b, and c denote coefficients greater than 0; and when T<=0.1, the controlling module determines that the first image data comprises the first pixel data having the gray brightness value which is not greater than the first threshold.

19. The display of claim 11, wherein the processing module is further configured to decrease a gray brightness value of W subpixel data of at least one of pixel data in the second image data corresponding to the second pixel units, and correspondingly increases respective gray brightness values of R subpixel data, G subpixel data and B subpixel data of the at least one of the pixel data.

20. The display of claim 11, wherein the processing module is further configured to increase a gray brightness value of W subpixel data of at least one pixel data in the second image data corresponding to the first pixel units, and correspondingly decreases respective gray brightness values of R subpixel data, G subpixel data and B subpixel data of the at least one of the pixel data.

* * * * *